US011358262B2

(12) United States Patent
Pedicini et al.

(10) Patent No.: US 11,358,262 B2
(45) **Date of Patent: *Jun. 14, 2022**

(54) FASTENER DRIVING APPARATUS

(71) Applicant: Tricord Solutions, Inc., Franklin, TN (US)

(72) Inventors: Christopher Pedicini, Franklin, TN (US); John Witzigreuter, Canton, GA (US)

(73) Assignee: TRICORD SOLUTIONS, INC., Franklin, TN (US)

( * ) Notice: Subject to any disclaimer, the term of this patent is extended or adjusted under 35 U.S.C. 154(b) by 192 days.

This patent is subject to a terminal disclaimer.

(21) Appl. No.: 16/797,070

(22) Filed: Feb. 21, 2020

(65) Prior Publication Data

US 2020/0171640 A1 Jun. 4, 2020

Related U.S. Application Data

(63) Continuation-in-part of application No. 16/168,827, filed on Oct. 24, 2018, now abandoned.

(60) Provisional application No. 62/900,751, filed on Sep. 16, 2019.

(51) Int. Cl.

| | |
|---|---|
| ***B25C 1/04*** | (2006.01) |
| ***B25C 5/13*** | (2006.01) |
| *B25C 1/06* | (2006.01) |

(52) U.S. Cl.

CPC ..... *B25C 5/13* (2013.01); *B25C 1/047* (2013.01); *B25C 1/06* (2013.01)

(58) Field of Classification Search

CPC .. B25C 1/047; B25C 1/04; B25C 1/06; B25C 5/13

See application file for complete search history.

(56) References Cited

U.S. PATENT DOCUMENTS

| | | | | |
|---|---|---|---|---|
| 5,503,319 | A * | 4/1996 | Lai | B25C 5/15 173/203 |
| 5,720,423 | A * | 2/1998 | Kondo | B25C 1/04 227/130 |
| 8,011,441 | B2 * | 9/2011 | Leimbach | B25C 1/047 173/1 |
| 8,602,282 | B2 * | 12/2013 | Leimbach | B25C 1/041 227/8 |
| 8,800,834 | B2 * | 8/2014 | Pedicini | B25C 1/04 227/2 |
| 9,539,714 | B1 * | 1/2017 | Pedicini | B25C 1/04 |

(Continued)

*Primary Examiner* — Andrew M Tecco
(74) *Attorney, Agent, or Firm* — Xsensus LLP

(57) ABSTRACT

A fastener driving apparatus featuring at least one gas spring and a drive mechanism, comprising a plurality of lifters, for selectively engaging and disengaging said at least one gas spring to energize the gas spring. The lifters the gas spring to energize the gas spring and thereafter release the gas spring, wherein the gas spring releases a portion of its potential energy and accelerates an anvil to engage a fastener. The lifters may engage the gas spring at the same time for a portion of the operational cycle of the apparatus, and the operational cycle may include an intermediate stopping point, which after resumption of a lifter on the gas spring after the stopping point, a relatively small increase of energy in the gas spring thereafter is required to generate a sufficient energy in the gas spring to effectively drive a fastener.

17 Claims, 7 Drawing Sheets

(56) References Cited

U.S. PATENT DOCUMENTS

| | | | | |
|---|---|---|---|---|
| 9,962,821 | B2 * | 5/2018 | Pedicini | B25C 1/06 |
| 10,065,300 | B2 * | 9/2018 | Pedicini | B25C 1/06 |
| 10,525,575 | B2 * | 1/2020 | Tanji | B25F 5/006 |
| 10,569,403 | B2 * | 2/2020 | Namouz | B25C 1/045 |
| 10,695,899 | B2 * | 6/2020 | Scott | B25C 1/041 |
| 10,946,504 | B1 * | 3/2021 | Pedicini | B25C 1/047 |
| 2006/0180631 | A1 * | 8/2006 | Pedicini | B25C 1/06 227/130 |
| 2012/0136537 | A1 * | 5/2012 | Galasso | F16F 9/003 701/37 |
| 2014/0069671 | A1 * | 3/2014 | Leimbach | B25C 5/13 173/1 |
| 2015/0375381 | A1 * | 12/2015 | Tanji | B25C 1/06 227/146 |
| 2016/0096259 | A1 * | 4/2016 | Pedicini | B25C 1/047 227/146 |
| 2017/0100829 | A1 * | 4/2017 | Pedicini | B25C 1/047 |
| 2017/0355069 | A1 * | 12/2017 | Scott | B25C 1/047 |
| 2017/0361441 | A1 * | 12/2017 | Namouz | B25C 1/008 |
| 2017/0361444 | A1 * | 12/2017 | Namouz | B25C 1/047 |
| 2018/0133763 | A1 * | 5/2018 | Kehoe | E03C 1/308 |

* cited by examiner

FASTENER DRIVING APPARATUS

CROSS REFERENCE TO RELATED APPLICATIONS

The present disclosure claims priority under 35 United States Code, Section 119 on the U.S. Provisional Patent Application, Ser. No. 62/803,939, filed on Feb. 11, 2019, the disclosure of which is incorporated by reference and 62/900,751 filed on Sep. 16, 2019, the disclosures of which are incorporated by reference. The present disclosure also is a continuation-in-part and claims priority under 35 United States Code, Section 120 on the U.S. Non-Provisional patent application Ser. No. 16/168,827 filed on Oct. 24, 2018, the disclosure of which is incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE DISCLOSURE

In accordance with the present disclosure, a fastener driving apparatus is described which derives its power from an electrical source, preferably rechargeable batteries, and uses a motor to actuate a gas spring. In an embodiment, a first (lower) lifter and a second (upper) lifter actuate an anvil or anvil assembly, which anvil or anvil assembly is part of or operatively coupled to the gas spring. The actuation of the anvil or anvil assembly upon the gas inside the gas spring increases the potential energy in the gas spring. After a sufficient increase in such potential energy, the anvil or anvil assembly may be released by or disconnected from the lifter or lifters and the piston of the gas spring may commence movement to cause the anvil or anvil assembly anvil to move, and in an embodiment, the movement is toward and into contact with a fastener such that the anvil drives the fastener. After such movement of the anvil or anvil assembly, the lifter or lifters may re-engage the anvil or anvil assembly to return the anvil or anvil assembly to a position where it may act or acts on the gas spring to increase the potential energy contained in the gas spring.

By using a multi-stage lifting configuration that is in contact with an anvil or anvil assembly during a substantial portion of the operational cycle, the present apparatus allows for more precise control of the operational cycle and an improved safety profile. For example, the lower lifter can raise the anvil or anvil assembly from a starting point that is most distal from the gas spring to a half-way stability point, at which time the motor may stop so that the lower lifter is no longer exerting a force on the anvil/anvil assembly, and the upper lifter may continue to pull the anvil/anvil assembly further upward to energize the gas spring. Thereafter, the upper lifter may disconnect from the anvil/anvil assembly to allow the gas spring to act on and move the anvil/anvil assembly to drive a fastener.

The apparatus may further comprise at least one sensor or other means of detecting a stall and or/a jam in the operation of the apparatus. For example, there may be an event that the drive of a fastener is not complete (e.g., if the anvil/anvil assembly jams in a downward/driving direction). The sensor or sensors may detect that the anvil had not completed its forward stroke and continue to allow the motor to operate to take the drive force off of the anvil and or anvil assembly. Additionally, if it is detected the current drawn by the motor of the apparatus exceeds a multiple of the nominal current that would be required to compress the gas spring, a jam would be indicated and the control circuit can cut power to the motor and, optionally, lock the lifter or lifters and/or anvil/anvil assembly in place to allow clearing of the jam, for example. The advantages of this embodiment include the ability for the mechanism to self-clear a light jam and protecting the apparatus from damage in the case of a very heavy jam. Furthermore, it protects the user by relieving the downward pressure on the anvil in the event the user has to clear a jam.

The apparatus may further comprise a one-way bearing that prevents the anvil/anvil assembly from being driven backwards in connection with its driving of a fastener or a nail. The apparatus may also comprise a bumper that may receive at least a portion of the force of impact of the anvil/anvil assembly during the operational cycle.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present disclosure will become better understood with reference to the following detailed description and claims taken in conjunction with the accompanying drawings, in which like reference numerals refer to like elements throughout the description of several views of the drawings, and in which

DETAILED DESCRIPTION OF THE DISCLOSURE

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the disclosure. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Figure 1:
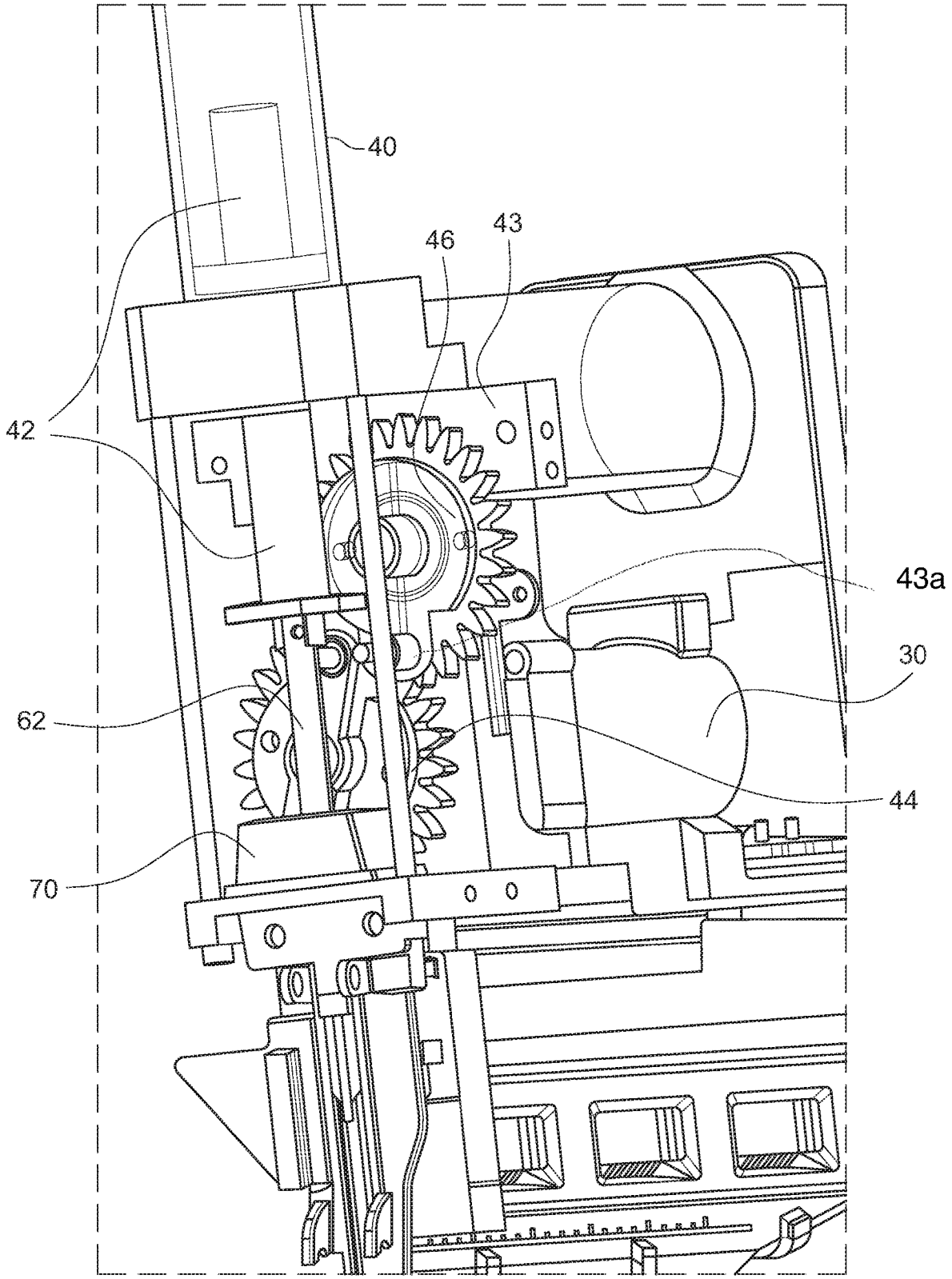
FIG. 1 shows a perspective view of a fastener driving apparatus, in accordance with an exemplary embodiment of the present disclosure.
Figure 2:
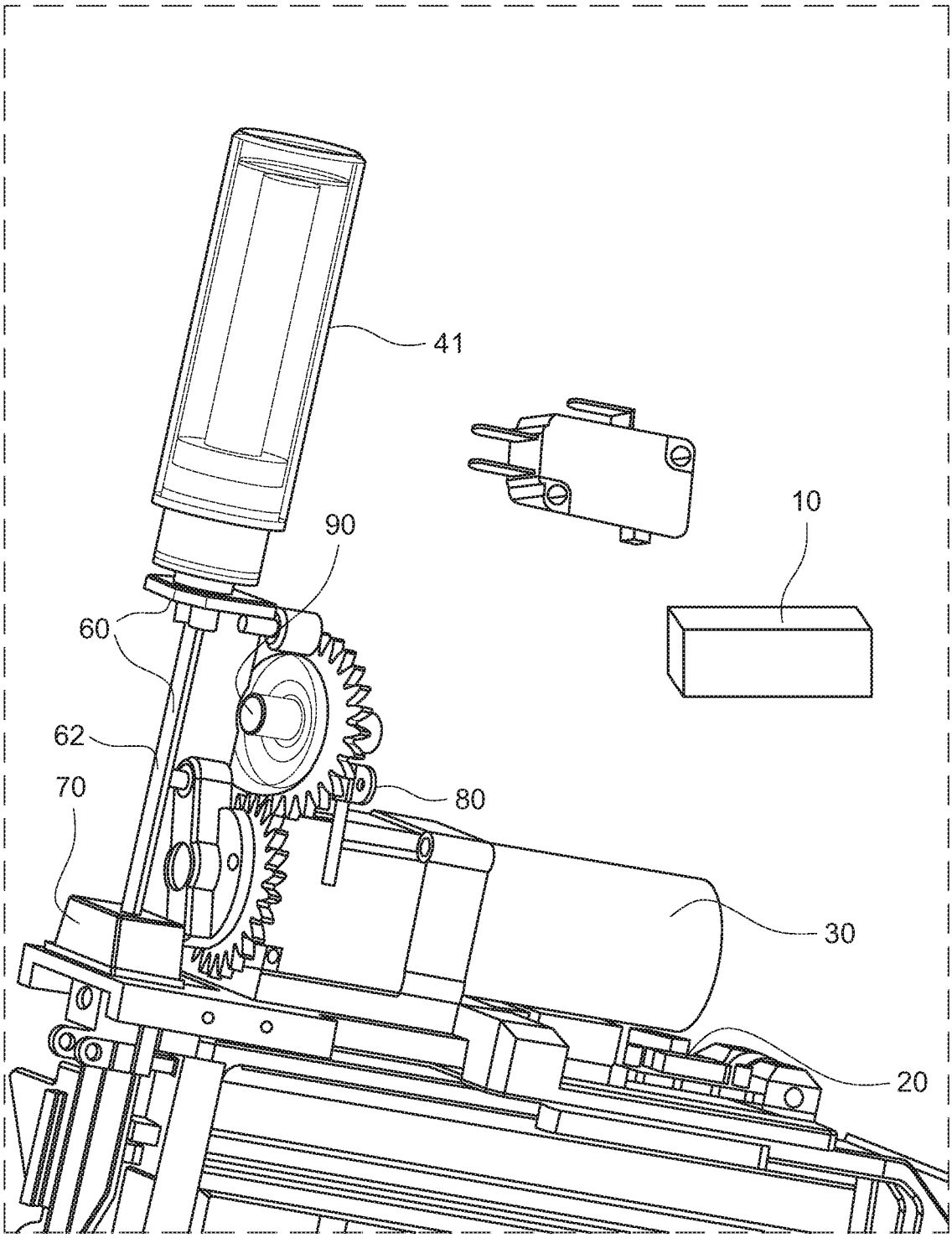
FIG. 2 shows a perspective view of a fastener driving apparatus in accordance with an exemplary embodiment of the present disclosure in which the anvil drive assembly is near the point of maximum potential energy in the gas spring.
Figure 3:
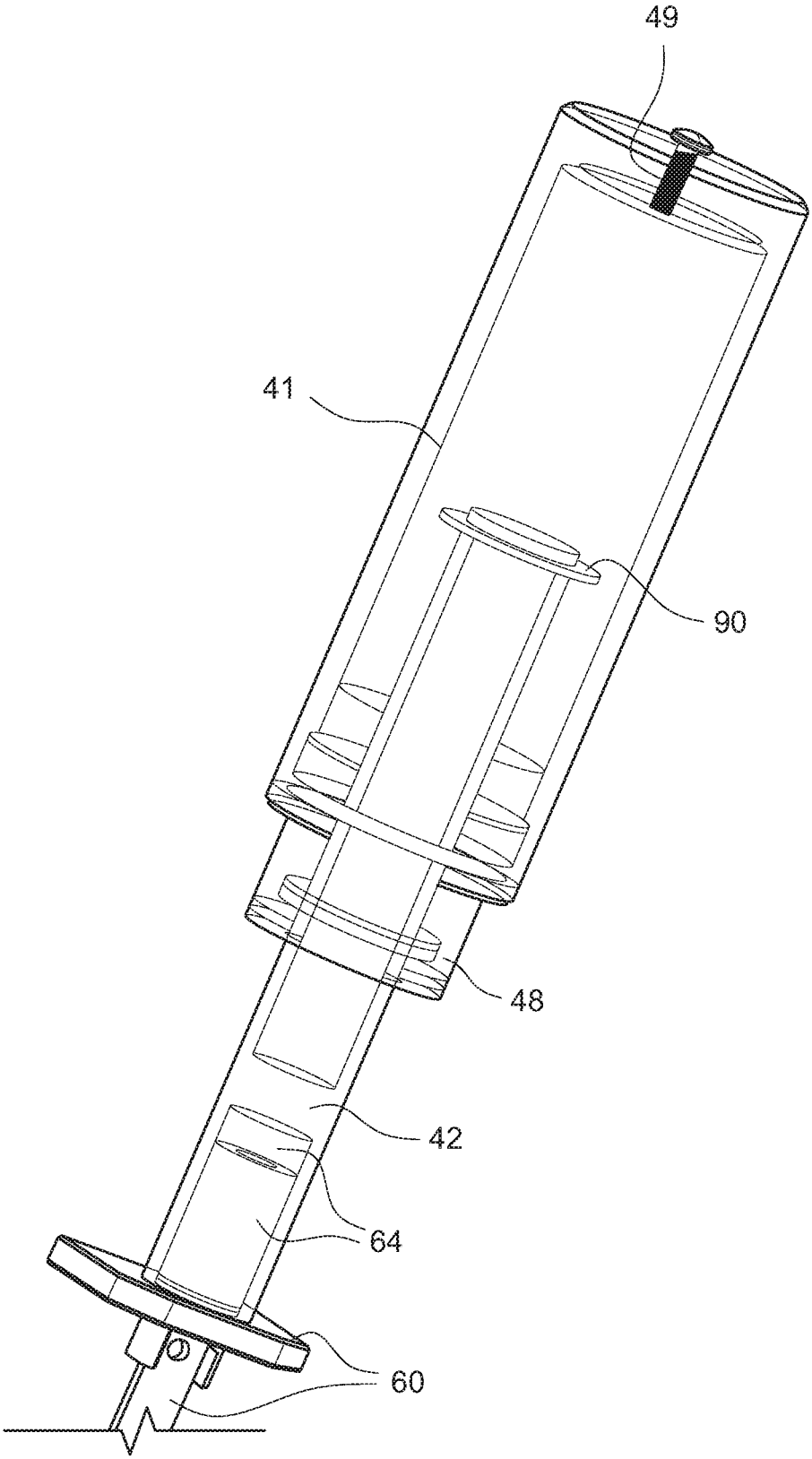
FIG. 3 shows a perspective view of a gas spring for a fastener driving apparatus, in accordance with an exemplary embodiment of the present disclosure.

The present disclosure provides for a fastener driving apparatus. In an embodiment, and referring to FIGS. 1, 2, and 3 the apparatus 100 comprises a power source 10, a control circuit 20, a motor 30, a gas spring 40, at least a first lifter 44 and a second lifter 46, an anvil 62 (which anvil may be part of an anvil assembly 60) and at least one bumper 70. The gas spring includes a gas spring piston 42 that is at least partially disposed within a sealed chamber (also referred to herein as a gas spring cylinder) 41 as shown in FIG. 3, and which piston 42 is operatively coupled to the anvil 62/anvil assembly 60. A bumper 70 is preferably disposed as part of the apparatus to absorb a portion of the force of impact of the anvil/anvil assembly.

Figure 5:
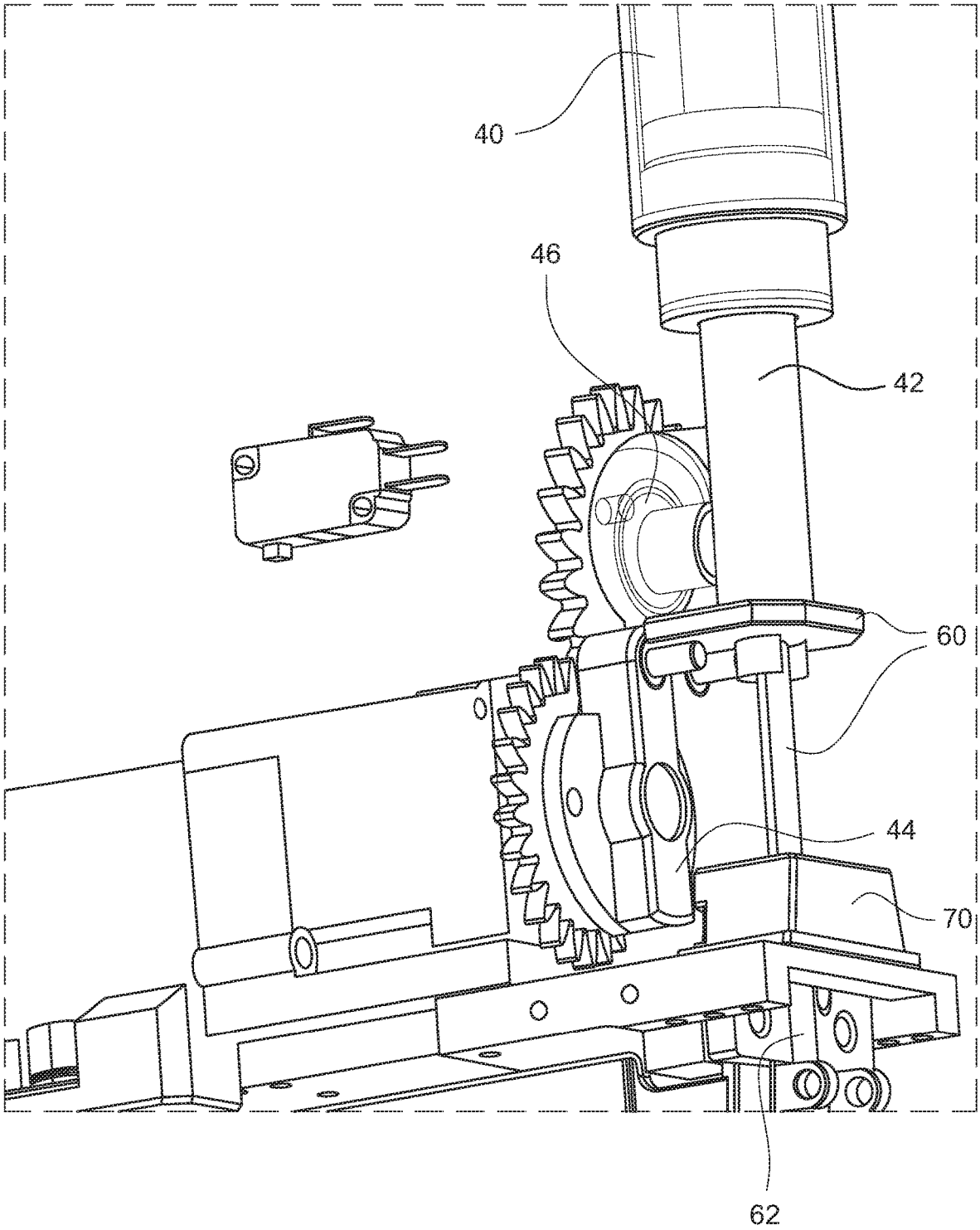
FIG. 5 shows a perspective view of a fastener driving apparatus in accordance with an exemplary embodiment of the present disclosure, in which the apparatus stops in in an intermediate position.

The first and second lifting mechanisms 44 and 46 (each also referred to as a "lifter" herein) may comprise at least one toothed gear 43 that is capable of engaging the anvil 62/anvil assembly 60 to selectively move the anvil 62/anvil assembly 60 during the operational cycle of the apparatus 100. The first lifter 44 may move the anvil 62/anvil assembly 60 from a first position or a position that is distal to the gas spring 40 toward the gas spring 40 by rotating itself, the gear teeth of the lifter, or other engagement region of the lifter (such as a roller 43*a*), to engage the anvil 62/anvil assembly 60. In an embodiment, the first lifter 44 moves the anvil 62/anvil assembly 60 a portion of the distance toward the gas spring 40, and as the anvil 62/anvil assembly 60 reaches a stable midpoint (an example of which midpoint is shown in FIG. 5), the motor 30 can stop. In an embodiment, first lifter 44 and second lifter 46 engage the anvil 62/anvil assembly simultaneously for a portion of the operational cycle of the apparatus. In an embodiment, the motor 30 restarts and the second lifter 46 thereafter continues to lift the anvil 62/anvil assembly 60 toward and upon/against the gas spring 40, thus causing the piston 42 of the gas spring to move to increase the potential energy within the gas spring. The second lifter 46 comprises a region that does not engage the anvil 62/anvil assembly 60, and when that region is reached, the gas spring may then act on the anvil 62/anvil assembly 60 to actuate the anvil 62/anvil assembly 60 (through the potential energy that had accumulated in the gas spring, for example) away from the gas spring to drive a fastener. In an embodiment, the motor continues to operate and engage the at least one gas spring to relieve at least 80% of the gas spring force on the anvil after the anvil has been released from the lifter and moved towards the fastener.

The apparatus 100 may also include a detection means 80 (shown in FIG. 2 and also referred to herein as a detector) to detect if the anvil assembly had completed a fastener drive and detect if an abnormal event such as a fastener jam in the apparatus 100 that requires removal of a fastener has occurred, for example. The detection can also occur by reading the current drawn by the motor 30, for example. If, for example, the current drawn is determined to be in excess of the nominal current for compressing the gas spring piston 42, the detector 80 can then signal the control circuit 20 to cut power to the motor 30 thus preventing damage to the apparatus and further allowing the lifter to engage and reduce the load on the anvil 62 or anvil assembly 60 from the gas spring. This improves the safety profile by allowing the jam to be cleared safely and not when it is under load. In an embodiment, where the detector is configured to detect a movement of the anvil or anvil assembly (such as a movement away from the drive of the fastener), the at least one lifter may remain powered until the detector detects such movement of the anvil or anvil assembly.

The gas spring 40 may further comprise at least one of a seal 48 and a fill valve 49 as shown in FIG. 3. The seal and/or fill valve may preferably comprise a single element such as a lip or cup seal. In an embodiment, the seal is a rod seal that is disposed on the piston of the gas spring. It was unexpectedly discovered in the inventive process that by employing a rod seal along with high gas pressure, (in excess of 200 psi) that the volume of the gas spring cylinder could be significantly reduced as compared to prior art. For example, using a piston seal with a ¾" diameter piston inside a gas spring of 1.5" diameter with a gas pressure of 400 psia, such configuration was able to accomplish the equivalent energy delivery of a 1.5" diameter gas spring with a gas pressure of 100 psia and cylinder diameter of 3.0". In a preferred embodiment, the operating pressure of the apparatus is 300 psia. It was a further unexpected discovery that the increased pressure allows the present device to function more uniformly with respect to ambient pressure. For example, in a city at elevation such as Albuquerque N. Mex., the nominal atmospheric pressure causes a reduction of energy of about 3% in the prior art but less than 1% in case of the present apparatus. A further unexpected advantage of the rod seal was that the pressure increase inside the gas spring was far less than as seen prior art apparatuses that comprise a piston seal instead of a rod seal. That is, an advantage is that the rod seal permits an apparatus of a more compact size as the rod seal does not require as much of gas chamber volume for the same stroke in order to achieve the constant force. The loss of energy in a gas spring stroke is related to the amount of "air volume displaced" during the movement of the gas spring from an energized to a de-energized position. The air volume displaced in the case of a rod seal is the area of the rod times the stroke. In the case of a piston seal, it is the area of the piston times the stroke, which is a larger area due to the fact that the piston is necessarily larger than the rod. This resulted in an unexpected increase in the conversion of gas spring energy to fastener drive energy in that there was less energy loss with the rod seal that occurs in the case of a piston seal.

In an embodiment, the pressure increase in the piston of said at least one gas spring during actuation of the at least one gas spring by the drive mechanism is less than 30% of the pressure in said piston prior to being acted on by the drive mechanism. In an embodiment, and shown in FIG. 3, the gas spring piston comprises a piston flange 50. In a preferred embodiment, the area of the piston flange 50 is no more than 80% of the cross sectional area of the gas spring cylinder. The relatively small size of the flange 50 in relation to the size of the piston contributes to a substantial increase in the energy output of the apparatus, as the flange configuration results in an improved airflow, and therefor an unexpected increase in efficiency of the apparatus. This efficiency resulted from the elimination of an unexpected airbrake effect which otherwise occurs as a result of the high piston velocities during the fastener drive stroke.

Figure 6:
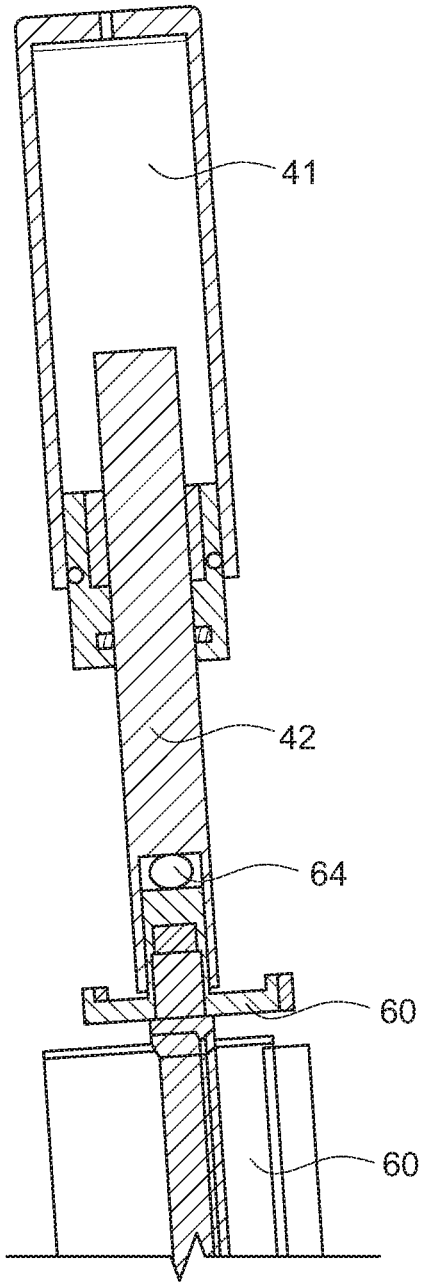
FIG. 6 shows a perspective view of the fastener driving apparatus in accordance with an exemplary embodiment of the present disclosure in which a compliance is present between the anvil or anvil assembly and the gas spring piston that allows limited movement in the plane that is perpendicular to the fastener drive axis.

In an embodiment, it was unexpectedly discovered that adding compliance 64 between the anvil or anvil assembly and the gas spring piston that allows limited movement in the plane that is perpendicular to the fastener drive plane resulted in an increased seal and gas spring life as measured by gas spring pressure during cycling. An exemplary embodiment of such compliance 64, in the form of a coupling between the anvil assembly and the gas spring piston, is shown in FIG. 3 and FIG. 6. An exemplary coupling of a compliance 64 of the present disclosure may be a ball-and-socket joint arrangement. This unexpected discovery is thought to be a result of the loads seen during a fastener drive which previously could cause the seal 48 to burp a small amount of gas during the impacting and or fastener drive. This further improved the wear characteristics on the seal by reducing side-loading on the seal from the lifting mechanism.

Figure 7:
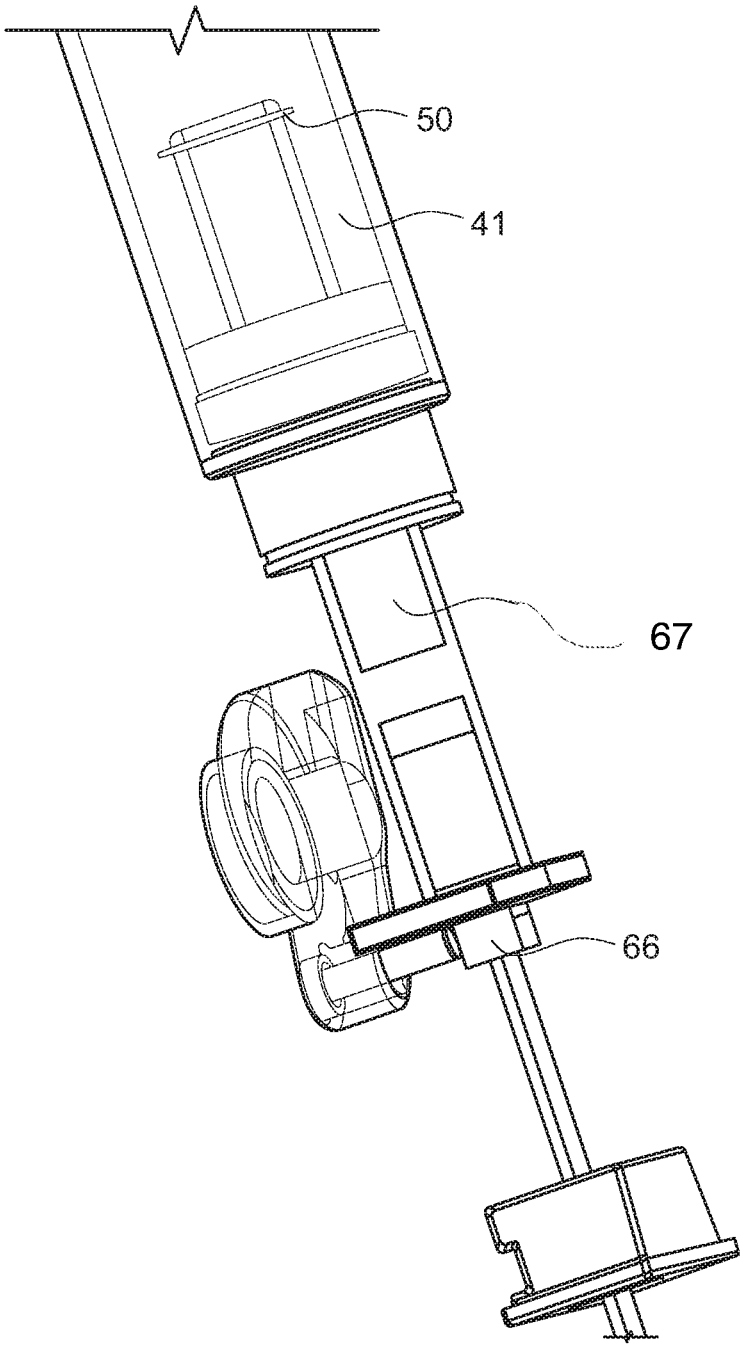
FIG. 7 shows a perspective view of the anvil assembly comprising at least two distinct materials of construction in accordance with an exemplary embodiment of the present disclosure.

In a further embodiment, and referring to FIG. 7, it was discovered that if the anvil assembly comprises an area 66 of high modulus of elasticity material (such as in the region of the anvil or anvil assembly that is in contact with the lifters) and a low density material for the area 67 of the anvil or anvil assembly that engages piston that the overall life and operation of the apparatus was improved. It is preferable that the portion of the anvil or anvil assembly that contacts the lifters has an elastic modulus of at least 25 million psi and that the portion of the anvil assembly which engages the gas spring (including the gas spring piston) has a density of less than 0.15 pounds per cubic inch. Exemplary materials are steels and stainless steels for the anvil/anvil assembly component that contacts the lifter and aluminum or magnesium for the gas spring piston and gas spring piston engagement region on the anvil/anvil assembly.

The apparatus may also comprise a one way bearing or clutch 90 (shown in FIG. 2) that prevents the anvil 62/anvil assembly 60 from being drawn backward during the operational cycle of the apparatus.

At least one bumper 70 may be disposed on the apparatus 100 for absorbing a portion of the force of impact of the anvil 62/anvil assembly 60, to reduce wear and tear on the components of the apparatus 100. The at least one bumper 70 may be of an elastic material, and may be disposed on the apparatus 100 at any position where it is capable of absorbing a portion of the force of impact by the anvil/anvil assembly.

Figure 4:
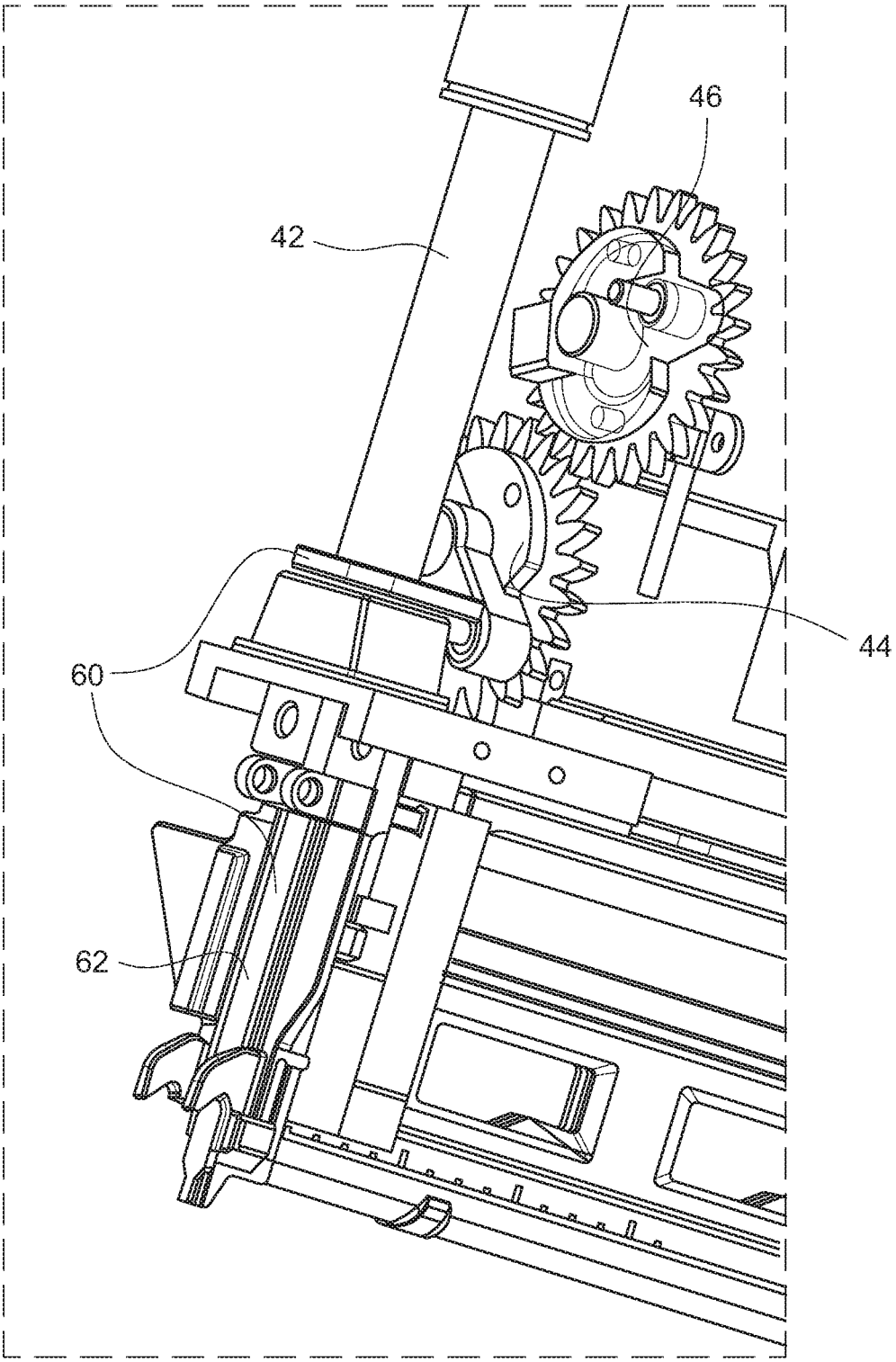
FIG. 4 shows a perspective view of a fastener driving apparatus in accordance with an exemplary embodiment of the present disclosure, in which a lifter is increasing the gas spring compression energy as the gas spring moves from the finish of the fastener drive stroke.

At least one of the lifters is capable of returning the anvil 62/anvil assembly 60 to and/or retaining the anvil 62/anvil assembly 60 in the position that is distal to the gas spring prior to commencement of another operational cycle. This configuration is shown in FIG. 4.

In an embodiment, the driving cycle of the apparatus 100 disclosed herein may start with an electrical signal, after which a circuit connects a motor 30 to the electrical power source 10. The motor 30 is operatively coupled to at least one lifting mechanism. In an operational cycle of the apparatus 100, a first or lower lifting mechanism 44 may act on the anvil 62/anvil assembly 60 to lift the anvil 62/anvil assembly 60 from a point that is distal to the gas spring 40. At an intermediate midpoint of the cycle where the anvil 62/anvil assembly 60 is stable, the motor 30 may stop as a preferred stopping point. It was discovered that this stopping results in a lower latency (i.e., the time between a trigger pull and a fastener drive) than if the stopping point was without a lifter engaged or only engaged within 10% of the lifting stroke.

The mechanism can continue when the second or upper lifting mechanism 46 thereafter continues to actuate the anvil 62/anvil assembly 60 into or upon the gas spring 40 to increase the potential energy within the gas spring. The second or upper lifting mechanism 46 thereafter may eventually temporarily release from or disengage the anvil 62/anvil assembly 60 to allow the gas spring 40 to act on and move the anvil 62/anvil assembly 60 back toward the point that is distal to the gas spring 40 so that the anvil 60/anvil assembly 62 may impact or drive a fastener.

By providing an intermediate stopping point (FIG. 5) in the operational cycle of the apparatus, the following benefits are realized. The gas spring may be partially energized or charged before the stopping point such that, after resumption of the engagement of the at least one lifter on the gas spring after the stopping point, a relatively small increase of energy in the gas spring thereafter is required to generate a sufficient amount of stored energy in the gas spring for subsequent release to effectively drive a fastener. Furthermore, the stopping point permits for secure retention of the anvil/anvil assembly in a fixed position in the event that there is a jam in the apparatus, such that the operator may clear the jam without concern that the gas spring would apply a force to the fastener resulting in a hazardous condition for the operator.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
a fastener
at least one gas spring, said at least one gas spring comprising a chamber and a piston disposed within said chamber
a drive mechanism, said drive mechanism capable of selectively engaging and disengaging said at least one gas spring, said at least one gas spring capable of moving to an energized position upon being engaged by said drive mechanism, said drive mechanism comprising a plurality of lifting mechanisms,
an anvil assembly, said anvil assembly comprising an anvil,
wherein said drive mechanism selectively lifts said at least one gas spring to apply a force on said at least one gas spring to move said piston of said at least one gas spring and thereafter releases from and ceases applying a force on said at least one gas spring, wherein said at least one gas spring releases a portion of its potential energy and accelerates said anvil to engage a fastener,
wherein the drive mechanism continues to operate and re-engages the at least one gas spring to relieve force on the anvil prior to stopping of the drive mechanism.

2. The fastener driving apparatus of claim 1, wherein said drive mechanism comprises a first lifting mechanism and a second lifting mechanism, wherein in an operational cycle of the apparatus, the first lifting mechanism actuates the at least one gas spring for a portion of the cycle, and the second lifting mechanism thereafter actuates the at least one gas spring for a subsequent portion of the cycle before the drive mechanism ceases applying a force on the at least one gas spring.

3. The fastener driving apparatus of claim 2, wherein the first lifting mechanism remains engaged with the at least one gas spring for a period of the operational cycle in which the second lifting mechanism is engaged with the at least one gas spring.

4. The fastener driving apparatus of claim 2, wherein the operational cycle comprises a stopping point after the first lifter has engaged the at least one gas spring and after the second lifter has engaged the at least one gas spring.

5. The fastener driving apparatus of claim 1, wherein the gas spring comprises a rod seal and the gas spring has an operating pressure of at least 200 psia during a portion of the cycle.

6. The fastener driving apparatus of claim 1 further comprising at least one detector to detect at least one position of the anvil, anvil assembly and/or gas spring.

7. The fastener drive apparatus of claim 6 in which at least one lifter mechanism remains powered until the detector detects movement of the anvil away from the fastener.

8. The fastener driving apparatus of claim 1, said anvil assembly comprising at least two materials, said first material comprising an elastic modulus of at least 30 million psi and said second material having a density of less than 0.15 pounds per cubic inch.

9. The fastener driving apparatus of claim 1, said piston further comprising a flange, and wherein the piston flange area is no more than 80% of the cross sectional area of said chamber and wherein the gas pressure increase within the gas spring is less than 30% of the initial pressure during any point in the operational cycle of the apparatus.

10. The fastener drive apparatus of claim 1 in which the control circuit reduces power to the motor if the motor current exceeds 150% of the average current drawn while the potential energy of the gas spring is increasing.

11. The fastener drive apparatus of claim 1 wherein the drive mechanism further comprises a one way clutch.

12. The fastener driving apparatus of claim 1, the apparatus further comprising an operative connection between one of the anvil and anvil assembly and the gas piston, said connection permitting compliance in a plane perpendicular to the stroke of the anvil.

13. A fastener driving apparatus, the apparatus comprising
a power source,
a control circuit,
a motor,
a fastener,
at least one gas spring, said at least one gas spring comprising a chamber and a piston disposed within said chamber, said piston capable of moving linearly within said chamber
a drive mechanism, said drive mechanism capable of selectively engaging and disengaging said at least one gas spring, said at least one gas spring capable of moving to an energized position upon being engaged by said drive mechanism, said drive mechanism comprising a plurality of lifting mechanisms,
an anvil assembly, said anvil assembly comprising an anvil,
a compliance operatively coupling said gas spring piston and said anvil assembly, said compliance permitting movement of at least one of the gas spring piston and said anvil assembly in a direction that is perpendicular to the linear movement of said gas spring piston
wherein said drive mechanism selectively lifts said at least one gas spring to apply a force on said at least one gas spring to move said piston of said at least one gas spring and thereafter releases from and ceases applying a force on said at least one gas spring, wherein said at least one gas spring releases a portion of its potential energy and accelerates said anvil to engage a fastener.

14. The fastener driving apparatus of claim 13, wherein the operational cycle comprises a stopping point after a first lifter has engaged the at least one gas spring and after a second lifter has engaged the at least one gas spring.

15. The fastener driving apparatus of claim 13, wherein the drive mechanism continues to operate and re-engages the gas spring to relieve force on the anvil prior to stopping of the drive mechanism.

16. The fastener driving apparatus of claim 13, said piston further comprising a flange, and wherein the piston flange area is no more than 80% of the cross sectional area of the gas spring cylinder and wherein the gas pressure increase within the gas spring is less than 30% of the initial pressure during any point in the operational cycle of the apparatus.

17. The fastener drive apparatus of claim 13, said apparatus further comprising at least one detector to detect at least one position of the anvil, anvil assembly and/or gas spring, wherein at least one lifter mechanism remains powered until the detector detects anvil movement away from the fastener.

* * * * *